United States Patent [19]

Henges, Jr. et al.

[11] 4,433,514

[45] Feb. 28, 1984

[54] CEILING SYSTEM FOR SMALL BUILDINGS

[75] Inventors: J. Gordon Henges, Jr., St. Louis County; Steve W. Schulte, St. Charles, both of Mo.

[73] Assignee: J Henges Enterprises, Inc., Earth City, Mo.

[21] Appl. No.: 379,628

[22] Filed: May 19, 1982

[51] Int. Cl.[3] ..... E04C 1/10

[52] U.S. Cl. ..... 52/94; 52/262; 52/588

[58] Field of Search ..... 52/593, 588, 262, 395, 52/94

[56] References Cited

U.S. PATENT DOCUMENTS

| | | | |
|---|---|---|---|
| 2,120,861 | 6/1938 | Hastings | 52/262 |
| 2,164,681 | 7/1939 | Fould | 52/588 |
| 2,803,856 | 8/1957 | Kofahl | 52/262 |
| 3,100,556 | 8/1963 | De Ridder | 52/588 |
| 3,455,070 | 7/1969 | Wiklund | 52/593 |
| 4,196,555 | 4/1980 | Henges | 52/588 |

FOREIGN PATENT DOCUMENTS

| | | | |
|---|---|---|---|
| 459622 | 1/1937 | United Kingdom | 52/264 |

*Primary Examiner*—John E. Murtagh
*Assistant Examiner*—Kathryn Ford
*Attorney, Agent, or Firm*—Gravely, Lieder & Woodruff

[57] ABSTRACT

A ceiling system for a small building includes panels that span the space between the side walls of the building and rest on end caps that extend over the upper edges of the walls for the building. The end caps have upwardly directed sections which, along with facia trim strips, obscure the peripheral surfaces of the panels. Each panel includes a surrounding metal frame having inwardly turned flanges and a composite filler member formed from an upper protective layer, a lower decorative layer, and an intermediate insulating layer. The sides of each frame are configured to interlock the panel of that frame with the frames of the adjacent panels, and are further configured to enable the panels to pivot into interlocking engagement.

11 Claims, 3 Drawing Figures

CEILING SYSTEM FOR SMALL BUILDINGS

BACKGROUND OF THE INVENTION

This invention relates to small buildings, and more particularly to ceilings for small buildings assembled from prefabricated components.

Prefabricated components of a modular nature are available for erecting small buildings in relatively short time and without the need for expensive skilled labor, and these components usually take the form of wall panels that will connect together side-by-side. Indeed, some panels merely pivot relative to each other and snap together which makes the erection of the building walls extremely quick and simple (see U.S. Pat. No. 4,196,555). The roofs and ceilings currently used on such buildings do not, however, lend themselves to the same efficiencies.

The typical roof of a small building having walls constructed from modular wall components includes conventional steel decking which is laid on the upper ends of the walls to span the opening between opposite walls. This in itself is time consuming because the steel decking is available only in very narrow strips which must be cut to the correct length, lifted to the top of the building, and fitted to adjacent strips. If the building is to be used outdoors, an additional roof structure is usually installed over the decking. Once the steel decking is in place, a dropped ceiling is hung from it. This involves installing the usual hangers and suspending a grid from them. Acoustic panels are then fitted to most of the grid openings, while flush-type lighting fixtures are normally installed in a few. Thus, the installation of the ceiling requires almost as much time as the installation of the roof. Furthermore, the drop ceiling reduces the effective height of the working space for the building, and makes the building seem more confining than it actually is.

SUMMARY OF THE INVENTION

One of the principal objects of the present invention is to provide a simple modular ceiling system for small buildings that are constructed from modular wall panels. Another object is to provide a ceiling system of the type stated which is attractive in appearance and does not detract from the working space within the building. A further object is to provide a ceiling system of the type stated which is installed rapidly and with a minimum amount of labor. An additional object is to provide a modular ceiling system of the type stated, the modules of which are simple in construction and easy to manufacture. Another object is to provide a small building that is formed entirely from prefabricated components, including a modular ceiling of the type stated. These and other objects and advantages will become apparent hereinafter.

The present invention is embodied in a ceiling system including a plurality of panels that extend from one side wall of a building to the other, connecting means for maintaining adjacent panels in alignment, and supporting means engaged with the upper ends of the side walls for the building for providing a surface on which the ends of the panels rest. The invention also consists in the parts and in the arrangements and combinations of parts hereinafter described and claimed.

DESCRIPTION OF THE DRAWINGS

In the accompanying drawings which form part of the specification and wherein like numerals and letters refer to like parts wherever they occur—

DETAILED DESCRIPTION

Figure 1:
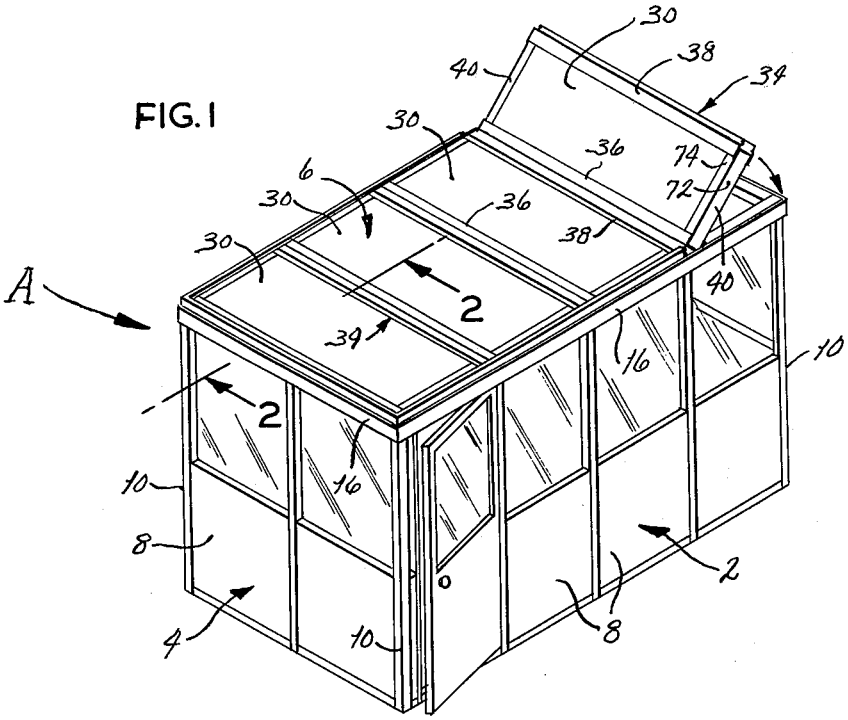
FIG. 1 is a perspective view of a small building provided with a ceiling system constructed in accordance with and embodying the present invention, the last panel of the ceiling system being illustrated pivoting into a horizontal disposition at the end of the building.

Referring now to the drawings, a small building A (FIG. 1) of rectangular shape has side walls 2 and end walls 4, and in addition a ceiling 6 that extends over and encloses the space surrounded by the walls 2 and 4. The building A is suitable for many uses—in plant offices, guard houses, parking lot attendant booths, to name a few. The side walls 2 and end walls 4 are of modular construction, each having a plurality of modular panels 8 that are set side-by-side and are joined to the adjacent walls 2 or 4 to enclose a rectangular space. Some of the panels 8 may be solid throughout, while others may have windows. Still other wall panels 8 may have doors in them. The panels 8 may along their sides be provided with members which, during the assembly procedure, enable one panel 8 to pivot relative to the panel 8 to which it is to be attached and then snapped into engagement with that panel so that the panels 8 are interlocked with considerable ease. Also the wall panels 8 that extend to the corners of the building A may be joined through special corner posts 10. Wall panels 8 having the capability of pivoting with respect to each other and corner posts 10 that are capable of accommodating such wall panels 8 so that they can be joined together at right angles are disclosed in U.S. Pat. No. 4,196,555, issued Apr. 8, 1980.

Each wall 2 and 4 along the upper ends of its panels 8 may be provided with a header frame 12 that fits over the panels 8 of that wall 2 or 4 and maintains those panels 8 in precise alignment.

The ceiling 6 includes ceiling caps 16 (FIGS. 1 & 2) that extend along the tops of side walls 2 and end walls 4 and serve as both trim pieces for the upper edges of the walls 2 and 4 and supports for the remainder of the ceiling 6. More specifically, each ceiling cap 16 is preferably an aluminum extrusion consisting of a horizontal section 18 that overlies the upper ends of the wall panels 8 for the walls 2 or 4 and a vertical section 20 which projects upwardly from the outer edge of the horizontal section 18. In addition, the ceiling cap 16 has two ribs 22 that project downwardly from its horizontal section 18, and these ribs 22 merge into horizontal feet 24, the spacing between which is such that the feet 24 lie directly over the front and back top margins of the wall panels 8 or over the header frames 12 along them. The front foot 24 includes a flange 26 which extends downwardly along the front face of the wall panels 8 over which the cap 16 extends, while the rear foot 24 has another flange 26 that extends downwardly along the rear faces of the wall panels 8. Thus, the feet 24 and flanges 26 of each ceiling cap 16 properly locate that ceiling cap 16 along the upper ends of the wall panels 8 which compromise each wall 2 and 4. The horizontal section 18 serves as a support for the ceiling 6 while the ribs 22 rigidify that support. The ceiling cap 16 maintains the ceiling 6 in the proper location above walls 2 and 4 by preventing the ceiling 6 from sliding with respect to the walls 2 and 4. It further serves as a facia trim around the periphery of the ceiling 6.

The ceiling 6, like the side walls 2 and the end walls 4, is modular in nature in that it also consists of (FIGS. 1 & 2) a plurality of panels 30 which are positively interlocked along their sides and are supported at their ends on the side walls 2. In effect, the panels 30 extend from one side wall 2 to the other side wall 2, bridging the space between the two side walls 2. At their ends, the ceiling panels 30 rest on the horizontal legs 18 of the ceiling caps 16 that extend along the wall panels 8 for the side wall 2. The outwardly presented sides of the endmost ceiling panels 30 extend along and rest on the horizontal sections 18 of the ceiling caps 16 that extend over the panels 8 for the two end walls 4. Moreover, the ceiling 6 is trimmed off by facia trim strips 32 (FIG. 2) that lie along the periphery of ceiling 6 and fit between the vertical sections 20 of the ceiling caps 16 for all four walls 2 and 4, and the nearby sides or ends of the ceiling panels 30, whatever the case may be.

Each ceiling panel 30 has a peripheral frame 34 (FIG. 1) of rectangular configuration, and that frame is composed of a left connecting section 36, a right connecting section 38, and two end sections 40. All four sections 36, 38 and 40 are preferably aluminum extrusions, and moreover the right connecting section 36 is configured to positively interlock with the left connecting section 38 of an adjacent panel 30 (FIG. 2) while the left connecting section 38 is configured to positively interlock with the right connecting section 36 of another adjacent panel 30. The two end sections 40 extend between the ends of the two connecting sections 36 and 38. In addition, each ceiling panel 30 includes a composite filler member 42 which occupies the space enclosed by the frame 34. Indeed, the frame 34 extends around, rigidifies, and to a measure unitizes the composite member 42. In this regard, the composite member 42 is composed of preferably three layers 44, 46 and 48 which are laid one upon the other before the frame 34 is assembled.

Each of the side members 36 and 38 of the frame 34 is generally I-shaped in cross-sectional configuration, and as such includes a center web 50 (FIG. 2) and a pair of mounting flanges 52 that project rearwardly from the web 50 over the upper and lower surfaces of the composite member 42 for the panel 30 of which that section 36 or 38 forms a part. In effect, the member 42 is captured between the mounting flanges 52 along its side edges, so that the mounting flanges 52 not only position the connecting sections 36 or 38 on the member 42, but also hold the layers 44, 46 and 48 together along the sides of the member 42.

In addition to its mounting flanges 52, each of the sections 36 and 38 has a pivot flange 54 which is presented upwardly and likewise extends from the web 50. Indeed, the upwardly presented surfaces of the pivot flange 54 and the upper mounting flange 52 on each section 36 and 38 are flush. The pivot flange 54 of the right section 36 has a convex rib 56 (FIG. 3) that extends the full length of the section 36 parallel to the web 50 from which it is spaced. The rib 56 projects downwardly and is of arcuate cross-sectional configuration, that is its surface constitutes a segment of a cylinder. The pivot flange 54 on the left connecting section 38, on the other hand, contains a groove 58 and a lip 60 that projects laterally beyond the groove 58 and is offset below the main portion of the groove 58. Both the groove 58 and the lip 60 extend the full length of the connecting section 38, and moreover the groove 58 opens upwardly and has an arcuate cross-sectional configuration that conforms to that of the convex rib 56 on the right connecting section 36. Thus, the convex rib 56 in the pivot flange 58 for the right connecting section 36 of one panel 30 will fit into the groove 58 in the pivot flange 58 for the left connecting section 38 of the adjacent panel 30 so that the two panels 30 can pivot relative to each other. Not only do the rib 56 and groove 58 enable adjacent panels 30 to pivot, but they further cooperate with other elements to lock the panels 30 together in a horizontal disposition. When adjacent panels 30 are so locked (FIG. 2), the upper mounting flanges 52 on the two panels 30 are flush and the lip 50 of the left connecting section 38 on the one panel underlies the pivot flange 54 on the right connecting section of the other panel 30.

At the lower ends of the respective webs 50 for the right and left connecting sections 36 and 38 on the two panels are locking flanges 62 that are about the same width as the pivot flanges under which they lie. The locking flange 62 on the right connecting section 36 has a ramp 64 (FIG. 3) and a groove 66 along the high end of the ramp 64, and both the ramp 64 and the groove 66 extend the full length of the section 38. The locking flange 62 on the left connecting section 38 has an upwardly offset portion 68 and a rib 70 at the end of that portion. Both the offset portion 68 and the rib 70 extend the full length of the right connecting section 38. Moreover, the width of the offset portion 68 is about equal to the space between the groove 66 and the small end of the ramp 64 on the right connecting section 36. The ramp 64, the groove 66, the offset portion 68 and the rib 70 are all configured such that when one panel 30 is pivoted downwardly relative to an adjacent panel 30 at the pivot flanges 54 on the respective right and left connecting sections 36 and 38 of those panels 30, or more specifically at the convex rib 56 on the right section 36 and the groove 58 on the left section 38, the two locking flanges 62 on those right and left connecting sections 36 and 38 will come together, and the rib 70 on the locking flange 62 of the left section 38 will ride up the ramp 64 on the locking flange 62 of the right section 36, in which case the offset portion 68 will flex slightly. At the end of the ramp 64, the rib 70 will snap into the groove 66 of the locking flange 62 on the right section 36 to thereby secure the two sections 36 and 38 together and the respective panels 30 to which they are attached as well. When the two locking flanges 62 are so interlocked (FIG. 3), their lower faces are flush and the panels 30 of which they form a part lie in the same plane. Thus, adjacent ceiling panels 30 are pivoted into a positive interlocking condition.

The end sections 40 of the frame 34 are U- or channel-shaped, having webs 72 and flanges 74 (FIG. 1). The webs 72 are about the same height as the webs 50 on the connecting sections 36 and 38, while the flanges 74 are very similar to the mounting flanges 52 on the connecting sections 36 and 38.

The frame 34 extends around and rigidifies the composite member 42 and further serves to hold the three layers 44, 46 and 48 of that member together, at least at the periphery of the member 42. The intermediate layer 46 is the thickest of the three layers 44, 46 and 48 that constitute the composite member 42 (FIG. 2), it constituting a core that is formed from a lightweight material that is a relatively poor conductor of heat and thus has good thermal insulating properties and sound insulating properties as well. Preferably the intermediate layer 46 is a slab of cellular material such as expanded polystyrene. The lower layer 44 should have good acoustical properties and should further be attractive in appearance. It may be composed of a plurality of acoustical tiles which are attached to the downwardly presented surface of the intermediate layer 46 by a suitable adhesive so that the entire downwardly presented surface of the intermediate layer 46 is covered. The upper layer 48, on the other hand, is quite thin, yet difficult to penetrate, and covers the entire upwardly presented surface of the softer intermediate layer 46. It is likewise attached to the intermediate layer 46 with a suitable adhesive and may be formed from a sheet material such as so-called hardboard or Masonite board or sheet steel or aluminum. Thus, the upper layer 48 serves a protective purpose, while the lower layer 44 is primarily decorative.

Once the three layers 44, 46 and 48 are joined together into the composite member 42, frame sections 36, 38 and 40 are fitted over the edges of the composite member 42 and secured in place, thus completing a panel 30.

Each facia trim strip 32 includes (FIG. 2) a vertical leg 76 and a lip 78 projected laterally from the upper end of the vertical leg 76. In terms of height, the vertical leg 76 is slightly shorter than the webs 50 and 72 of the sections 36, 38 and 40 for the frame 34 that surrounds each ceiling panel 30. The vertical legs 76 of the trim strips 32 lie inwardly from vertical sections 20 of the ceiling caps 16, and indeed are interposed between those vertical sections 20 and the webs 50 and 72 of the frame sections 36, 38 and 40 that lie along the periphery of the ceiling 6. The lips 78 of the trim strips 32, on the other hand, overlie the flanges 54 and 74 that lie along the periphery of the ceiling 6.

The ceiling 6 is assembled quite simply and easily. First the ceiling caps 16 are installed over the upper edges of the side walls 2 and the end walls 4 or over the header frames 12 with the vertical sections 20 of the caps 16 presented outwardly. Then a ceiling panel 30 is laid over the horizontal sections 18 of the ceiling caps 16, that is, such that at least the ends of the panel 30 rest on the horizontal sections 18 of the ceiling caps 16 at one end of the partially completed building A. In effect, this panel 30 bridges the space between the upper ends of the two side walls 2, with the end sections 40 of its frame 34 lying on the horizontal sections 18 of the ceiling caps 16 at the upper ends of those side walls 2. Moreover, the left connecting section 38 lies over the horizontal section 18 on the ceiling caps 16 for the underlying end wall 4 at that end of the building A at which the first ceiling panel 30 is installed. This leaves the right connecting section 36 exposed between the upper ends of the two side walls 2. In this regard, the first panel 30 as well as the remaining panels 30 are installed with the pivot flanges 54 on their right and left connecting sections 36 and 38 presented upwardly.

Figure 3:
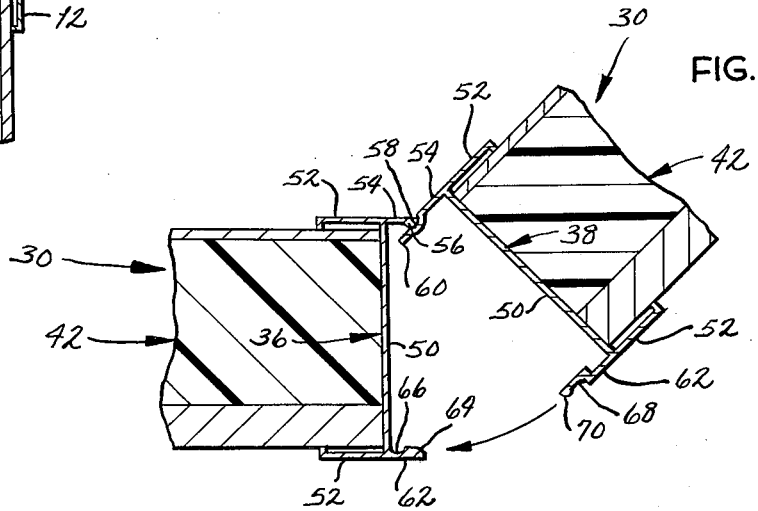
FIG. 3 is a sectional view showing one panel being pivoted toward a previously installed panel so that the pivoted panel will eventually interlock with the previously installed panel.

On the first panel 30 is in place, a second panel 30 is maneuvered into an oblique position adjacent to the first panel 30 such that its left connecting section 38 is adjacent to the exposed right connecting section 36 of the first panel 30. The second panel 30 is then manipulated to enable the groove 58 along the pivot flange 54 of its left connecting section 38 to receive the convex rib 56 along the pivot flange 54 of the right connecting section 36 for the first panel 30 (FIG. 3). The second panel 30 is then lowered, pivoting about the convex rib 56 on the right connecting section 36 for the first panel 30 as it does. As the second panel 30 approaches the ceiling caps 16 on the side walls 2, the locking flange 62 on its left connecting section 38 will approach the locking flange 62 on the right connecting section 36 of the first panel 30. Indeed, the rib 70 of the left connecting section 38 for the second panel 30 comes against the ramp 64 on the locking flange 62 for the right connecting section 36 of the first panel 30, and that ramp urges the rib 70 and the locking flange 62 of which it forms a part upwardly.

Figure 2:
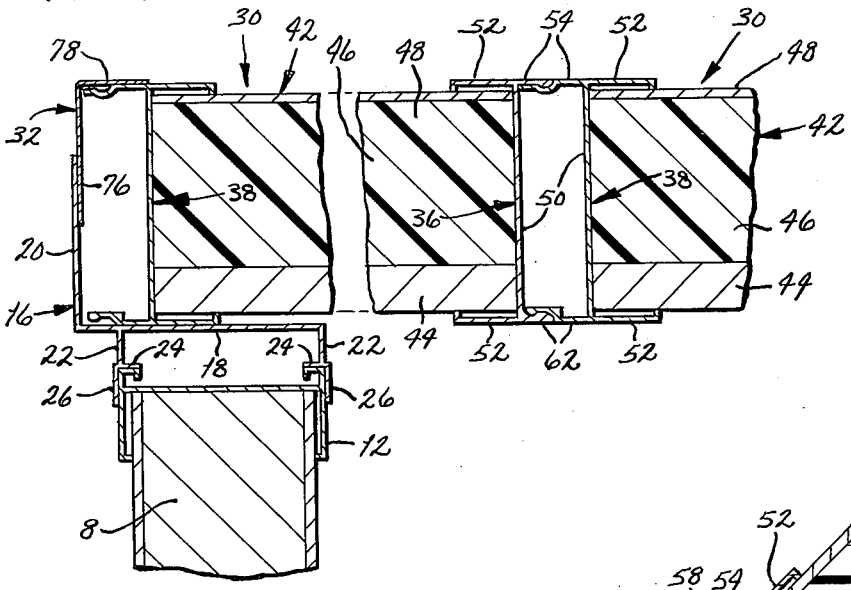
FIG. 2 is a sectional view taken along line 2—2 of FIG. 1 and showing the ceiling cap and the interlocked panels of the ceiling.

The rib 70 passes beyond the ramp 64, and when the second panel 30 has reached a horizontal disposition, snaps into the groove 66 in the locking flange 62 of the right connecting section 36 (FIG. 2). Thus, when the second panel 30 is fully supported on the ceiling caps 16 at the upper ends of the two side walls 2, the first and second panels 30 are interlocked at the right and left connecting sections 36 and 38 of their respective frames 34. The remaining panels 30 are installed in a similar manner, one after the other, until the space enclosed by the side and end walls 2 and 4 is completely covered. Whereas, the left connecting section 38 of the first panel 30 rests in part on the ceiling caps 16 over the end wall 4 at one end of the building A, the right connecting section 36 of the last panel 30 will rest in part on the ceiling caps 16 over the end wall 4 at the other end of the building A. Finally, after all of the panels 30 are in place, the vertical legs 62 of the facia trim strips 34 are fitted between the vertical sections 18 of the ceiling caps 16 and the adjacent connecting or end sections 36, 38 or 40 of the frames 34 for the ceiling panels 30. The trim strips 32 are then forced downwardly until their lips 64 come against the pivot flanges 54 at the periphery of the ceiling 6. The lips 64 also extend over the pivot flanges 54 and flanges 74 of the end sections 40. In this regard, each facia trim strip 34 extends the full length of the side wall 2 or end wall 4 over which it lies.

This invention is intended to cover all changes and modifications of the example of the invention herein chosen for purposes of the disclosure which do not constitute departures from the spirit and scope of the invention.

What is claimed is:

1. In a building having spaced apart side walls and spaced apart end walls that are joined to the side walls at corners, an improved ceiling system for closing the top of the building, said ceiling system comprising: ceiling caps fitted over the upper ends of at least the side walls, with each cap having a horizontal section and a vertical section that projects upwardly from the horizontal section, the vertical sections being presented outwardly from their respective horizontal sections so that the horizontal sections are located closest to the space between the side walls; and a plurality of rectangular ceiling panels, each extending from the ceiling cap on one side wall to the ceiling cap on the other side wall so as to bridge the space between the side walls, each panel having a first connecting section along one of its sides, a second connecting section along its other side and a filler member between the first and second connecting sections, each panel at one of its ends resting on the horizontal section of the ceiling cap for one side wall and at its other end resting on the horizontal section of the ceiling cap for the other side wall, whereby the vertical sections of the ceiling caps at least in part obscure the ends of the ceiling panels, the ceiling panels being arranged such that as to adjacent panels the first connecting section of the one panel is adjacent to the second connecting section of the other panel, the first and second connecting sections on adjacent panels being snapped together and positively interlocked such that the adjacent panels where they are interlocked cannot be displaced upwardly or downwardly with respect to each other.

2. The structure according to claim 1 wherein ceiling caps are also fitted over the upper ends of the end walls and these ceiling caps likewise have horizontal sections and vertical sections projecting upwardly from the horizontal sections, with the vertical sections being presented outwardly from their respective horizontal sections so that the horizontal sections are located closest to the space between the end walls; and wherein the connecting sections of the endmost ceiling panels rest on the horizontal sections of the ceiling caps that are over the end walls.

3. The structure according to claim 1 wherein each panel includes a frame which extends around its periphery and wherein the connecting sections for the panel form part of the frame and the filler member for the panel is within the frame.

4. The structure according to claim 3 wherein the frame for each panel includes a web that extends along the periphery of the filler member and flanges which turn inwardly from the web and overlie the upper and lower surfaces of the filler member for the panel.

5. The structure according to claim 3 wherein the filler member is composite in construction, including an upwardly presented protective layer, a downwardly presented decorative layer and an intermediate insulating layer.

6. The structure according to claim 1 wherein each ceiling cap further comprises feet which are connected to and extend downwardly from the horizontal section and engage the upper edges of the wall over which the ceiling cap is located.

7. The structure according to claim 1 wherein the connecting sections enable adjacent panels to pivot relative to each other and to snap into full engagement with each other.

8. The structure according to claim 7 wherein the first and second connecting sections have upwardly presented pivot flanges which enable adjacent panels to pivot relative to each other and downwardly presented locking flanges which cooperate with the locking flanges to interlock adjacent panels.

9. The structure according to claim 8 wherein the pivot flange of the first connecting section has a convex rib and the pivot flange of the second connecting section has a pivot groove that conforms in configuration to the rib so that adjacent panels can pivot relative to each other along the convex rib and the groove.

10. The structure according to claim 9 wherein the locking flange of the first connecting section includes a ramp and a locking groove at the end of the ramp; and wherein the locking flange of the second connecting section includes a locking rib that will ride up the ramp of the locking flange on a first connecting section and snap into the groove at the end of that ramp so as to lock two adjacent panels together.

11. In a building having side walls and end walls that are joined to the side walls at corners, an improved ceiling system for closing the top of the building, said ceiling system comprising: a plurality of panels each having a peripheral surface and extending from one side wall to the other; connecting means for maintaining adjacent panels in alignment; supporting means engaged with the upper ends of the side walls for supporting the panels at their ends, the supporting means having a horizontal section on which the ends of the panels rest and a vertical section which at least partially obscures the peripheral surfaces of the panels; and facia trim strips, each having a vertical leg and a lip projected laterally from the upper end of the vertical leg, the vertical leg of each strip being in part fitted between the vertical section of the supporting means and adjacent peripheral surfaces of the panels to obscure the peripheral surfaces of the panels, the lip of each strip being projected inwardly over the top surfaces of the panels.

* * * * *